US006819055B2

(12) United States Patent
Tessier

(10) Patent No.: US 6,819,055 B2
(45) Date of Patent: Nov. 16, 2004

(54) METHOD OF MONITORING A COPLANAR PLASMA DISPLAY PANEL USING A PULSE TRAIN WITH SUFFICIENTLY HIGH FREQUENCY TO STABILIZE THE DISCHARGES

(75) Inventor: Laurent Tessier, Fontaine (FR)

(73) Assignee: Thomson Licensing S.A., Boulogne-Billancourt (FR)

( * ) Notice: Subject to any disclaimer, the term of this patent is extended or adjusted under 35 U.S.C. 154(b) by 0 days.

(21) Appl. No.: 10/467,813

(22) PCT Filed: Feb. 14, 2002

(86) PCT No.: PCT/FR02/00561

§ 371 (c)(1),
(2), (4) Date: Aug. 12, 2003

(87) PCT Pub. No.: WO02/065441

PCT Pub. Date: Aug. 22, 2002

(65) Prior Publication Data

US 2004/0075397 A1 Apr. 22, 2004

(30) Foreign Application Priority Data

Feb. 15, 2001 (FR) ..... 01/02043

(51) Int. Cl.[7] ..... G09G 3/10

(52) U.S. Cl. ..... 315/169.1; 315/169.3; 315/169.4; 345/60

(58) Field of Search ..... 315/169.1, 169.3, 315/169.4; 345/60, 61, 62, 63, 68, 71.1; 313/491, 514

(56) References Cited

U.S. PATENT DOCUMENTS 4,063,131 A * 12/1977 Miller ..... 315/169.3
5,162,701 A 11/1992 Sano et al. ..... 315/169.4
5,233,272 A 8/1993 Whang et al. ..... 315/168
6,473,061 B1 * 10/2002 Lim et al. ..... 345/60

OTHER PUBLICATIONS

Patent Abstracts of Japan, vol. 2000, No. 05, Sep. 14, 2000, & JP 2000 047632 A, Feb. 18, 2000.
Patent Abstracts of Japan, vol. 2000, No. 09, Oct. 13, 2000, & JP 2000 173482 A, Jun. 23, 2000.
Patent Abstracts of Japan, vol. 1998, No. 11, Sep. 30, 1998, & JP 10 171399 A, Jun. 26, 1998.

* cited by examiner

*Primary Examiner*—James Vannucci
*Assistant Examiner*—Jimmy T Vu
(74) *Attorney, Agent, or Firm*—Joseph S. Tripoli; Harvey D. Fried; Patricia A. Verlangieri

(57) ABSTRACT

According to this method, before a high-frequency pulse train is applied between the two electrodes of a pair carried by one plate, at least one sustain pulse is applied between an electrode of this pair and an electrode of another plate of the panel.

As the sustain discharges are not generated between the same electrodes as the stabilized discharges, the electrodes may be moved further apart so as to lower the stabilization frequency without thereby having to increase the sustain voltages.

13 Claims, 2 Drawing Sheets

METHOD OF MONITORING A COPLANAR PLASMA DISPLAY PANEL USING A PULSE TRAIN WITH SUFFICIENTLY HIGH FREQUENCY TO STABILIZE THE DISCHARGES

This application claims the benefit, under 35 U.S.C. § 365 of International Application PCT/FR02/00561, filed Feb. 14, 2002, which was published in accordance with PCT Article 21(2) on Aug. 22, 2002 in French and which claims the benefit of French patent application No. 0102043, filed Feb. 15, 2001.

The invention relates to a plasma display panel addressing and driving method.

Document JP 10-171399 (HITACHI) describes a coplanar-type plasma panel comprising:

a rear plate provided with a first array of electrodes;

a front plate, parallel to the first, provided with a second array of pairs of electrodes orthogonal to the electrodes of the first array, the electrodes of each pair leaving between them discharge spaces positioned at the intersections of the electrodes of the first array and of the pairs of electrodes of the second array.

The addressing and the driving of a plasma display panel of this type generally comprise the following steps:

activation of a discharge in each of the intersection regions to be activated, by applying, at least, an address voltage pulse between the electrode of the rear plate and an electrode of the front plate which intersect in this region;

re-activation of a series of discharges in this region by applying a series of sustain voltage pulses between the same electrode of the front plate and the paired electrode of this same plate.

According to this method, the address discharge extends essentially perpendicular to the plates in the space, filled with discharge gas, which separates the plates; in contrast, the sustain discharges extend essentially parallel to the plates, along the front plate.

According to this conventional method, the instantaneous frequency of the sustain pulses is generally about 100 to 300 kHz and determines the luminosity of the panel; the sustain is called "positive" if the two electrodes of the pair always have a positive or zero potential with respect to the address electrodes and, in the opposite case, called "negative" or "bipolar" if this potential is alternately positive and negative (the sustain signals of the electrodes of the same pair are then offset by a half-phase).

The address pulses may be grouped together in groups of rows and are then also very close together.

To address and drive a panel of this type, document JP 10-171399 (HITACHI) also proposes to use pulses of very high frequency, substantially greater than 10 MHz.

If, as indicated in FIG. 3 of that document, the first array of electrodes comprises electrodes $A_1, A_2, \ldots, A_6$, and if the second array comprises pairs $(X, Y_1), (X, Y_2), \ldots, (X, Y_n)$, referring now to FIG. 1 of that document, the addressing and driving of the coplanar plasma display panel then comprise the following steps:

addressing or writing (phase IV) during the address voltage pulse resulting from the difference between the signal 107 applied to the electrode $Y_m$ and the signal 108 applied to the electrode A;

bipolar sustain by applying signals 101 generating conventional "low-frequency" sustain voltage pulses between the electrode $Y_m$ and the paired electrode X;

according to the invention presented in that document, a very-high-frequency "RF" signal 100 is furthermore applied during this sustain phase, on the side of that one of the electrodes $Y_m$ or X which serves as cathode; the application of this signal corresponds here to the sustain step VII.

According to that document, the purpose of applying a very-high-frequency signal, once the charges have formed between the electrodes after a conventional sustain discharge, is to prevent the ionic charges reaching the cathode and to vibrate the ionic charges between the electrodes, as shown schematically in FIG. 4-VII of that document; referring to FIG. 5, said document teaches:

that it is necessary to start applying the RF signal 100 before the conventional sustain discharge corresponding to the pulse 101 has resulted in the complete inversion of the charges on the dielectric layer which covers the electrodes; thus, the time $t_d$ separating the pulse front 101 from the first front of the RF signals must be substantially shorter than the cumulative time of the sustain discharge and of the complete invention of the charges;

that it is necessary for the half-period $t_w$ of the RF signal 100 to be short enough for the ionic charges not to have time to return to the cathode during a half-period; this condition generally results in very high frequencies difficult to employ.

According to that document, under these conditions, a discharge stabilized by the RF signal is obtained, which emits light with a luminous efficiency very much greater than that obtained with conventional discharges of lower frequency.

As an example, according to that document, when the distance separating two sustain electrodes at the point of the discharge is about 100 $\mu$m, when the discharge gas is an Ne/Xe mixture at a pressure of $0.4\times10^5$ Pa, the abovementioned conditions are as follows: $t_d<1$ $\mu$s approximately; $t_w<0.1$ $\mu$s approximately, corresponding to frequencies of greater than 20 MHz.

According to that document, in the method of driving the plasma display panel, each sustain step comprises a succession of conventional sustain discharges and of stabilized discharges:

a first discharge, generated by a conventional sustain pulse, intended to create ionic charges in the activated region, and a stabilized discharge, generated by a pulse train with a high frequency suitable for stabilizing the ionic charges created in the activated region.

Thus, the sustain discharge is used to activate or "ignite" the stabilized discharge.

The use of high frequencies poses major electronic problems which limit the use of this method for driving plasma display panels; to obtain stabilized discharges at a lower frequency, it is necessary to increase the distance separating the electrode X and the electrode Y of each pair, but the voltage required to obtain the conventional sustain discharge then increases, creating other drawbacks.

More Precisely:

to apply the conventional "low frequency" sustained signal that serves to initiate a discharge before application of the "high frequency" signal, it is beneficial to use electrodes close enough to limit the voltage needed for initiation;

to apply the "high frequency" signal, it is beneficial to use electrodes far enough apart as to prevent the ions from reaching one of the electrodes during the period of one alternation and thus obtain the desired stabilization effect for a frequency that is not too high.

Document U.S. Pat. No. 5,233,272, in particular FIG. 2, describes a plasma panel similar to a coplanar panel comprising, for each discharge space, an anode 40 and an auxiliary electrode 50 that are coplanar and carried by the same plate, and a cathode 60 carried by the other plate; unlike conventional coplanar panels, which have a lasting memory effect, no dielectric layer separates the electrodes so it is possible to obtain only a short-duration pseudomemory effect, that is to say a memory effect of conditioning by the previous discharge or by an adjacent source of primary particles; to drive such a panel, according to that document, pulses of high enough amplitude to obtain a succession of discharges are applied between the anode and the cathode; during application of these pulses, similar to sustained pulses, pulses of higher frequency are applied, between the coplanar electrodes 40 and 50, so as to disturb the movements of the ions and make them diffuse between the electrodes (column 2, lines 20–21 and 40–41; column 3, lines 38–39 and 57–58); this disturbance leads merely to the extension of the path of the ions between the electrodes (column 3, line 66 to column 4, line 4) and not to stabilization of these ions, as in document JP 10-171399; here, the purpose of applying the higher-frequency pulses is to improve the short-duration memory effect and to lower the pulse amplitude needed to obtain discharges (column 5); according to that document (especially "table" column 4) and the figures, to obtain the desired effect it is therefore important for the distance separating the electrodes between which the higher-frequency signal is applied (in this case the anode and the auxiliary electrode) to be less than the distance separating the electrodes between which the conventional sustain-type signal is applied; this arrangement is the opposite of that described above relating to document JP 10-171399 when it is desired to stabilize the discharges in a plasma panel with a lasting memory effect.

Documents JP 11-273576, JP2000-047631, JP2000-047632 and JP2000-173482 describe plasma panel structures specially adapted to obtain stabilized discharges with the aid of high-frequency pulse trains; however, the use of specific panel structures raises other cost problems.

The object of the invention is to avoid the aforementioned drawbacks, by proposing to use a conventional coplanar panel in a different way from that proposed in document JP 10-171399, so as to be able to stabilize the discharges at lower frequencies, without having to increase the voltage required to ignite the stabilized discharges.

For this purpose, the subject of the invention is a method of driving a coplanar-type plasma display panel comprising:

a first plate provided at least with a first array of electrodes, a second plate, parallel to the first, provided at least with a second array of pairs of electrodes, the overall direction of which is approximately orthogonal to that of the electrodes of the first array, the electrodes of each pair leaving between them discharge regions positioned at the intersections of the electrodes of the first array and of the pairs of electrodes of the second array, said method comprising:

the application of at least one series of sustain voltage pulses so as to generate sustain discharges in each of the intersection regions in which it is desired to sustain a discharge, and after at least one of said pulses generating a sustain discharge, the application, between the two electrodes of a pair crossing said region, of a pulse train with a frequency high enough to stabilize said discharge, characterized in that said sustain voltage pulses are applied between one of the electrodes of said pair and the electrode of the first plate crossing said region;

in each discharge region of the panel, the distance separating the electrodes of a pair is greater than the distance separating the electrode of the first plate crossing said region and the electrode of said pair between which said sustain voltage pulses are applied.

In general, the first plate is a "rear" plate and the second plate is a "front" plate facing the person observing the images to be displayed; the regions of intersection of the electrodes form discharge cells of the panel, which cells can be driven, whether activated or not, independently of one another, according to the voltage pulses applied to the electrodes.

Since the sustain voltage pulses are not applied between the same electrodes as the discharge-stabilizing pulse trains, it is possible to increase the distance between the stabilization electrodes of the front plate without affecting the voltage needed for the sustain; thus, a conventional coplanar structure is used, but unlike the prior art:

the sustain pulses are applied between electrodes of the first plate and the electrodes of the second plate; preferably, the plates are chosen to be spaced apart so as to be able to use conventional sustain voltages and conventional electronic components; the spacing is then generally between 100 and 150 $\mu$m; if each plate is provided with a dielectric layer with a thickness of 40 $\mu$m, the distance separating the array of electrodes of the first plate from the array of pairs of electrodes of the second plate is then between 180 and 230 $\mu$m; a distance as small as 90 $\mu$m between these electrodes could, if absolutely necessary, be envisaged;

the distance separating the electrodes of the pair of the second plate is greater than the distance separating the electrode of the first plate from the electrode of the second plate between which the sustain pulses are applied; thus, the gap between the coplanar electrodes, or distance separating the paired electrodes, is much greater than in the prior art so as to be able to stabilize the discharges by means of pulse trains of lower frequency than in the prior art; a gap of more than 500 $\mu$m may even be envisioned.

The invention may also have one or more of the following features;

the second array of pairs of electrodes is covered with a dielectric layer; thus, the conventional memory effect of coplanar panels is obtained;

said first plate is covered with a thin protective and secondary-electron-emitting layer and provided with phosphor layers that are positioned to absorb the ultraviolet radiation coming from the discharges and to emit visible radiation through the plate facing the front of said panel and these layers have a break in each region of intersection of the electrodes so as to expose, in this break, the surface of said thin subjacent protective layer.

If the first plate is the rear plate, at each intersection region or each cell, the rear plate and, as the case may be, the walls of the barriers separating these regions are provided with phosphors of different emission color—red, green and blue; unlike the prior art, the sustain discharges are ignited between the front plate and the rear plate; to facilitate the ignition at the rear plate, it is necessary, at the base of the discharges, for the surface of the plate to be made of a material capable of emitting secondary electrons by ion impact, such as magnesia (MgO); for this purpose, the layer of phosphors is removed in these regions so as to expose the MgO-based subjacent thin layer;

before the application of series of sustain voltage pulses, the application of an address voltage pulse between one of the electrodes of said pair and said electrode of the first plate so as to produce an address discharge in said region.

It is therefore possible to use the conventional addressing methods of the prior art, whether these be methods in which all the rows of the panel are addressed before the first sustain pulse (methods referred to as "ADS" or "ADM") or other addressing methods well known to those skilled in the art;

preferably, the distance separating the electrode of the first plate from the electrode of the second plate between which the sustain pulses are applied is less than 250 $\mu$m; furthermore, the distance separating the electrodes of the same pair at said intersections is greater than or equal to 250 $\mu$m; preferably, said frequency of the discharge-stabilizing pulse trains is less than 150 MHz, or even less than or equal to 60 MHz;

said pulse train is applied after each of the sustain pulses of said series or else continues to be applied throughout the application of said series of sustain pulses; this latter arrangement advantageously makes it possible to stabilize the maximum number of ions generated by the sustain discharges, thereby allowing the luminous efficiency of the panel to be further increased. It also makes it possible to limit the electrical losses caused by the switching of the high-frequency power circuit.

The subject of the invention is also a coplanar-type plasma display panel designed to apply the drive method according to the invention, comprising:

a first plate provided at least with a first array of electrodes;

a second plate, parallel to the first, provided at least with a second array of pairs of electrodes, the general direction of which is approximately orthogonal to that of the electrodes of the first array, the electrodes of each pair making between them discharge regions positioned at the intersections of the electrodes of the first array with the pairs of electrodes of the second array, characterized in that, in each discharge region, the distance separating the electrodes of a pair is greater than the distance separating the electrode of the first plate intersecting said region from any one of the electrodes of said pair.

It is between one of these electrodes of the pair and this electrode of the first plate that the sustain voltage pulses of the method according to the invention are applied.

The invention may also have one or more of the following features:

the distance between the first array of electrodes and the second array of pairs of electrodes is less than 250 $\mu$m and the distance separating the electrodes of the same pair at the intersections is greater than or equal to 250 $\mu$m;

the second array of pairs of electrodes is covered with a dielectric layer that is itself generally covered with a protective layer;

since said first plate is covered with a thin protective and secondary-electron-emitting layer and provided with phosphor layers that are positioned to absorb the ultraviolet radiation coming from the discharges and to emit visible radiation through the plate facing the front of said panel, these layers have a break in each region of intersection of the electrodes so as to expose, in this break, the surface of said thin subjacent protective layer.

The invention will be more clearly understood on reading the description which follows, given by way of non-limiting example and with reference to the appended figures in which.

Figure 1:
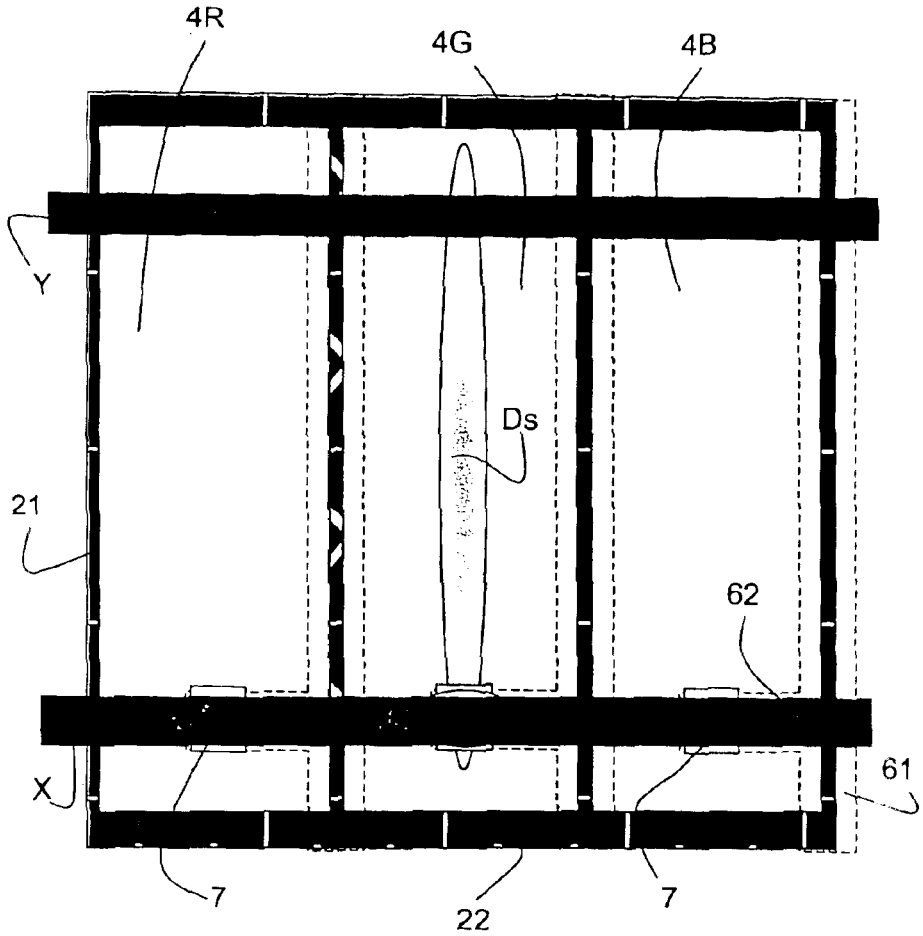
FIGS. 1 and 2 show schematically one embodiment of a group of three adjacent discharge regions of a coplanar display panel which may advantageously be used to implement the invention, FIG. 1 being a plan view and FIG. 2 being in cross section.
Figure 2:
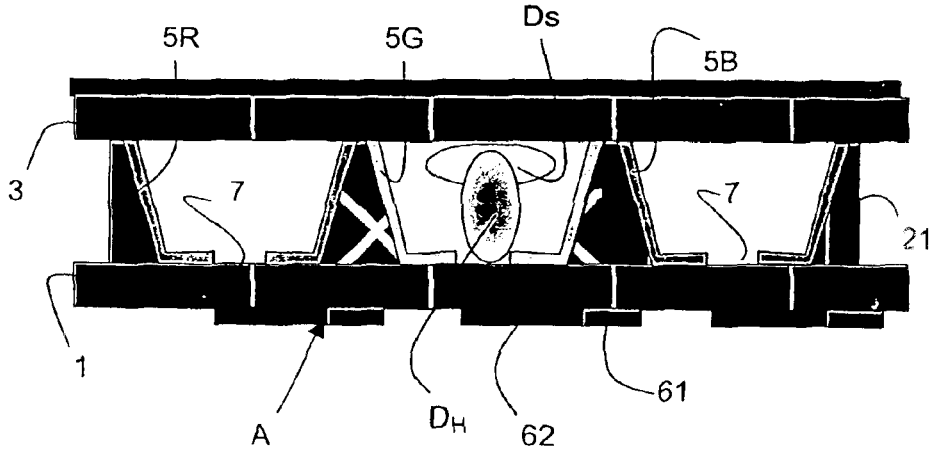

According to a preferred embodiment, and with reference to FIGS. 1 and 2, the coplanar panel used to implement the invention comprises:

a rear plate (not shown) provided with an array of electrodes A, the array being coated with a dielectric layer 1 provided with an array of barriers 21, 22;

a front plate (not shown) provided with an array of pairs of electrodes X, Y, the array being coated with a dielectric layer 3.

The overall direction of the electrodes X, Y of the front plate is orthogonal to that of the electrodes A of the rear plate.

The dielectric layers 1, 3 are themselves coated with a very thin layer for protection and for secondary electron emission, this layer (not shown) being based here on MgO.

The array of barriers is formed here by walls 21 extending parallel to the electrodes A of the rear plate and walls 22 extending parallel to the electrodes X, Y of the front plate, so as to define discharge regions 4R, 4G, 4B at the intersections of, on the one hand, the electrodes A and, on the other hand, the paired electrodes X and Y.

The tops of the barriers of the rear plate support the front plate.

The walls of the barriers and the dielectric layer 1 of the rear plate are covered with layers of phosphors 5R, 5G, 5B, capable of emitting in the red, the green and the blue respectively, when excited by ultraviolet radiation coming from localized discharges in the regions 4R, 4G, 4B respectively; the group of three adjacent discharge regions shown in FIGS. 1 and 2 therefore corresponds to one picture element or pixel of the image display panel for implementing the invention.

The electrodes A of the rear plate include a conductive bus 61 extending beneath the barriers over the entire height of the panel, which is provided, at each discharge region, with a protruding branch 62; each branch 62 of a given region 4R, 4G or 4B is placed opposite the electrode X of the pair X, Y which crosses said region, and lies near the middle of this region; opposite the free end of each branch 62 of the electrode X, the dielectric layer 1 contains no phosphors, so as to form a break 7 in the layers of phosphors 5R, 5G, 5B, so as, at this break, to expose the magnesia (MgO)-based surface of the thin protecting and secondary-electron-emitting layer and thus make the magnesia of this layer accessible to the discharge so that it can emit secondary electrons, favorable to a reduction in the ignition voltage; at these breaks 7, the surface of the MgO-based protective layer is therefore directly in contact with the discharge regions 4R, 4G, 4B; finally, the panel includes one electrode A per column of pixels.

The paired electrodes X, Y extend over the entire width of the panel; the panel comprises one pair X,Y per row of pixels; according to an alternative embodiment, one electrode X may be common to two adjacent rows of pixels, as described in document U.S. Pat. No. 5,162,701 (NEC).

Finally, according to an important feature of the invention, the distance between the pairs of electrodes X, Y in each pixel is greater than the distance between the array of electrodes A of the rear plate and that of pairs of electrodes X, Y of the front plate, that is to say greater than the sum of the distance between the plates and the thickness of the layers applied to these arrays; precise values will be given later.

Known conventional methods are used to produce the above coplanar panel, but these will not be described here.

Figure 3:
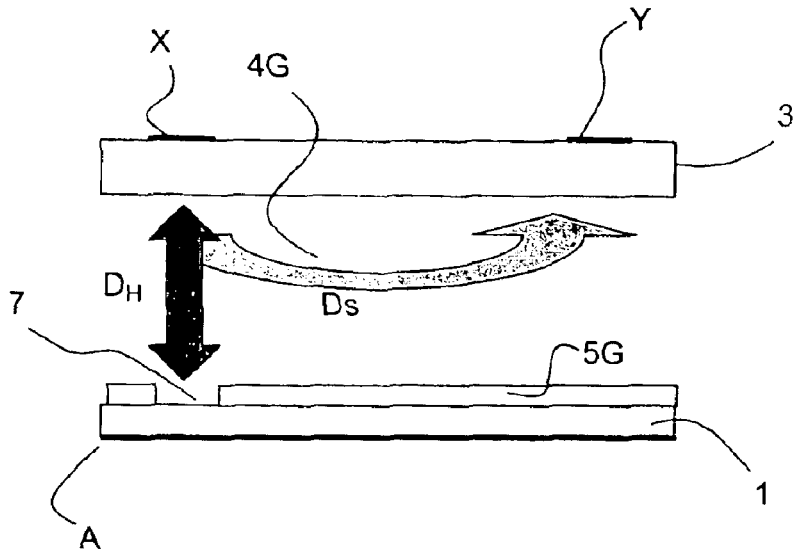
FIG. 3 shows a longitudinal sectional view of a discharge region of the group shown in FIGS. 1 and 2, illustrating the spreading of the discharges (arrows) according to one way of implementing the invention.
Figure 4:
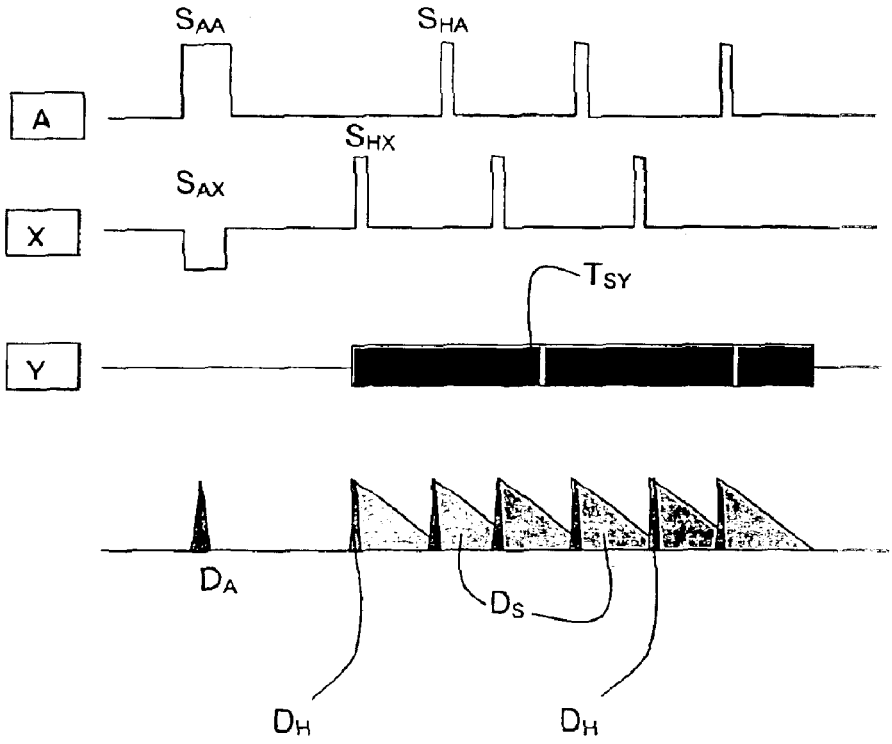
FIG. 4 shows, according to one way of implementing the invention, a timing diagram for the voltages applied to the various electrodes of the panel shown in FIGS. 1, 2 and 3.

To use this coplanar panel according to the invention, the electrodes are connected to a voltage supply system for the column electrodes A of the first array and for the paired electrodes X, Y of the second array; a supply system of this kind is known per se and will not be described here; conventionally, using this system, images are displayed on the panel by scanning this panel row by row, or group of rows by group of rows; conventionally, each scan is itself subdivided into several sub-scans, which make it possible to obtain the desired number of gray levels; referring to FIGS. 3 and 4, each sub-scan comprises at least the following steps:

- firstly, at each row discharge region to be activated, the application of an address voltage pulse between the electrode X of the row in question and the electrode A crossing this region, so as to produce an address discharge $D_A$ (not shown) in this region; this voltage pulse is obtained by simultaneously applying the signals $S_{AA}$ and $S_{AX}$ to the electrodes A and X, respectively;
- next, and according to the invention, again in this region, the application of series of sustain voltage pulses between the same electrode X of the row in question and the same electrode A crossing this region, so as to produce sustain discharges $D_H$ (shown in FIG. 3) in this region; these voltage pulses are obtained by alternately applying positive signals $S_{HX}$ and $S_{HA}$ to the electrodes A and X respectively; in this configuration, the electrodes A and X are used alternately as cathode and anode, and the sustain is called "bipolar"; other sustain configurations known from the prior art are conceivable, such as "positive" sustain, as described in document EP 855692 (NEC), or "negative" sustain;
- finally, at the same time as the sustain pulses, the application, between the electrode X and the paired electrode Y of the row in question, of at least one pulse train at a frequency high enough to transfer the sustain discharge between these electrodes and form a stabilized discharge $D_S$; this pulse train is obtained here by applying a radiofrequency signal $T_{SY}$ to the electrode Y; as in document JP 10-171399, the time interval elapsing between the application of a sustain pulse, $S_{HX}$ or $S_{HA}$, and the start of application of the pulse train $T_{SY}$, must be less than the time needed to invert the electrical charges resulting from this sustain discharge; preferably, unlike the method described in document JP 10-171399, in which the high-frequency pulse trains are interrupted before each sustain pulse, in this case the high-frequency pulse train is applied without any interruption, until the end of the sustain period relating to the sub-scan in question; this arrangement makes it possible to stabilize the maximum number of ions generated by the sustain discharges, to further improve the luminous efficiency of the panel and thus improve the electrical efficiency, since the number of energy-consuming high-frequency switching operations is thus limited.

The way of implementing the invention described above results in a succession of discharges $D_A$, and then the series $D_H$, $D_S$, as shown in the last timing diagram in FIG. 4; it may therefore be seen that the sustain discharges $D_A$ are used to ignite or reinforce the stabilized discharges $D_S$.

Because the breaks 7 expose an area of the MgO-based protective layer in direct contact with the discharge regions, the sustain voltage needed to obtain a discharge still has a conventional value; furthermore, the presence of these breaks makes it possible to limit damage to the layers of phosphors.

Thanks to the use of high-frequency pulses and to the stabilization of discharges which results therefrom, the luminous efficiency of the panel is very considerably improved.

Since, according to the invention, the sustain discharges $D_H$ and the stabilized discharges $D_S$ do not extend between the same electrodes (X and A in the case of the first ones, X and Y in the case of the second ones), it is possible to choose, independently:

- a distance between the electrodes X and A which is small enough to be able to use conventional sustain voltage values that are compatible with the usual electronic components for plasma panels;
- a distance between the electrodes X and Y which is large enough to be able to use lower frequencies to stabilize the discharges; this distance is preferably greater than or equal to 250 $\mu$m; a distance of between 500 $\mu$m and 1000 $\mu$m may also be envisaged in order to lower the discharge stabilization frequencies further; a high value of the gap between the coplanar electrodes advantageously avoids having to use transparent conducting materials for these electrodes, since such a gap offers a sufficient optical aperture through the front plate; this thus results in narrow and opaque, and therefore inexpensive, coplanar electrodes, as shown in FIG. 1.

With a gap of between 500 $\mu$m and 1000 $\mu$m between the coplanar electrodes X and Y, using a discharge gas of conventional composition and pressure, it is generally possible to stabilize the discharges at below 100 MHz, especially between 60 MHz and 30 MHz.

Preferably, the frequency of the sustain pulses $S_{HX}$, $S_{HA}$ is generally between 1 kHz and 50 kHz.

Thus, thanks to the invention, it is possible to use conventional coplanar panels to obtain stabilized plasma discharges, while using conventional sustain voltages and relatively low stabilization frequencies by means of simple and inexpensive adaptations such as the widening of the gap between the coplanar electrodes.

Coplanar panels of types other than those described may be used for implementing the invention, such as panels comprising a larger number of electrode arrays, panels in which the row electrodes are common to two adjacent rows of discharge regions, panels in which the discharge regions are arranged in a staggered configuration, as in document U.S. Pat. No. 5,825,128 (FUJI), and panels in which the pairs of coplanar electrodes are placed on the rear face, as described in document EP 945890 (THOMSON).

Addressing methods other than that described may be used to implement the invention, especially those which provide a priming step and/or an erase step.

What is claimed is:

1. A method of driving a coplanar-type plasma display panel comprising:

a first plate provided at least with a first array of electrodes, a second plate, parallel to the first, provided at least with a second array of pairs of electrodes, the overall direction of which is approximately orthogonal to that of the electrodes of the first array, the electrodes of each pair leaving between them discharge regions positioned at the intersections of the electrodes of the first array and of the pairs of electrodes of the second array, said method comprising the application of at least one series of sustain voltage pulses so as to generate sustain discharges in each of the intersection regions in which it is desired to sustain a discharge, and after at least one of said pulses generating a sustain discharge, the application, between the two electrodes of a pair crossing said region, of a pulse train with a frequency high enough to stabilize said discharge, wherein:

said sustain voltage pulses are applied between one of the electrodes of said pair and the electrode of the first plate crossing said region;

in each discharge region of the panel, the distance separating the electrodes of a pair is greater than the distance separating the electrode of the first plate crossing said region and the electrode of said pair between which said sustain voltage pulses are applied.

2. The method as claimed in claim 1, wherein the second array of electrodes is covered with a dielectric layer.

3. The method as claimed in claim 2, wherein, since said first plate is covered with a thin protective and secondary-electron-emitting layer and provided with phosphor layers that are positioned to absorb the ultraviolet radiation coming from the discharges and to emit visible radiation through the plate facing the front of said panel and these layers have a break in each region of intersection of the electrodes so as to expose, in this break, the surface of said thin subjacent protective layer.

4. The method as claimed in claim 1, wherein it also comprises, before the application of series of sustain voltage pulses, the application of an address voltage pulse between one of the electrodes of said pair and said electrode of the first plate so as to produce an address discharge in said region.

5. The method as claimed in claim 1, wherein:

the distance separating the electrode of the first plate from the electrode of the second plate between which the sustain pulses are applied is less than 250 $\mu$m;

the distance separating the electrodes of the same pair at said intersections is greater than or equal to 250 $\mu$m.

6. The method as claimed in claim 5, wherein said frequency of discharge-stabilizing pulse trains is less than 150 MHz.

7. The method as claimed in claim 6, wherein said frequency of discharge-stabilizing pulse trains is less than or equal to 60 MHz.

8. The method as claimed in claim 1, wherein said pulse train is applied after each of the sustain pulses of said series.

9. The method as claimed in claim 1, wherein said pulse train continues to be applied throughout the application of said series of sustain pulses.

10. A coplanar-type plasma display panel that can be used to implement the drive method as claimed in claim 1, comprising:

a first plate provided at least with a first array of electrodes;

a second plate, parallel to the first, provided at least with a second array of pairs of electrodes, the general direction of which is approximately orthogonal to that of the electrodes of the first array, the electrodes of each pair making between them discharge regions positioned at the intersections of the electrodes of the first array with the pairs of electrodes of the second array;

wherein, in each discharge region, the distance separating the electrodes of a pair is greater than the distance separating the electrode of the first plate intersecting said region from any one of the electrodes of said pair.

11. The panel as claimed in claim 10, wherein the distance between said first array of electrodes and said second array of pairs of electrodes is less than 250 $\mu$m and in that the distance separating the electrodes of the same pair at said intersections is greater than or equal to 250 $\mu$m.

12. The panel as claimed in claim 11, wherein the second array of electrodes is covered with a dielectric layer.

13. The panel as claimed in claim 12, wherein, since said first plate is covered with a thin protective and secondary-electron-emitting layer and provided with phosphor layers that are positioned to absorb the ultraviolet radiation coming from the discharges and to emit visible radiation through the plate facing the front of said panel, these layers have a break in each region of intersection of the electrodes so as to expose, in this break, the surface of said thin subjacent protective layer.

* * * * *